United States Patent [19]

Wentzel et al.

[11] Patent Number: 4,591,141

[45] Date of Patent: May 27, 1986

[54] PIVOT POINT SHEET FEEDER

[75] Inventors: Robert J. Wentzel, New Hyde Park; Walter E. Tallman, North Babylon, both of N.Y.

[73] Assignee: Burroughs Corporation, Detroit, Mich.

[21] Appl. No.: 474,878

[22] Filed: Mar. 14, 1983

[51] Int. Cl.[4] ..... B65H 1/08

[52] U.S. Cl. ..... 271/127; 221/180; 271/160; 271/164; 271/170

[58] Field of Search ..... 271/126, 127, 162, 164, 271/170, 171, 149, 150, 160; 221/259, 180, 43

[56] References Cited

U.S. PATENT DOCUMENTS

| | | | |
|---|---|---|---|
| 3,310,303 | 3/1967 | Schmidt | 271/170 |
| 3,520,533 | 7/1970 | Phleps | 271/127 |
| 3,533,617 | 10/1970 | Collins | 271/127 |
| 3,599,972 | 8/1971 | Miciukiewicz | 271/127 |
| 3,635,468 | 1/1972 | Suzuki | 271/170 |
| 4,269,407 | 5/1981 | Tsuda et al. | 271/127 |
| 4,362,296 | 7/1982 | Schmidt | 271/126 |
| 4,429,865 | 2/1984 | Okada | 271/170 |

FOREIGN PATENT DOCUMENTS

| | | | |
|---|---|---|---|
| 2058020 | 8/1981 | United Kingdom | 271/127 |
| 0627039 | 10/1978 | U.S.S.R. | 271/127 |

*Primary Examiner*—Bruce H. Stoner, Jr.
*Assistant Examiner*—John A. Carroll
*Attorney, Agent, or Firm*—Mark T. Starr; Kevin R. Peterson

[57] ABSTRACT

Disclosed is a sheet feeder for supplying single sheets of paper to a printer's paper feeding mechanism. The sheet feeder is pivotably mounted so that the paper supply is maintained in contact with a fixed position feed roller. The feed roller is actuated when a sheet of paper is to be fed into the printing mechanism. The sheet feeder's pivot point is chosen to provide constant feed pressure to the paper supply regardless of the size of the remaining paper supply.

6 Claims, 8 Drawing Figures

PIVOT POINT SHEET FEEDER

BACKGROUND AND OBJECTS OF THE INVENTION

Automatic sheet feeding apparatuses are well known in the prior art. In recent years, their popularity has increased with the proliferation of word processing systems.

In many of the word processing systems marketed today, each user is provided with a keyboard and CRT display. A letter quality printer is often shared by several users and must operate without operator intervention. As such, a mechanism must be provided to feed a sheet of paper into the printer in response to a keyboard entered command.

Printers are generally quite noisy. The printer's noise level may be reduced by providing a sound insulating cover. In order to avoid the necessity of removing the cover to feed in a sheet of paper, automatic paper feeders are often provided.

Many of the automatic sheet feeders utilize one or more rollers which contact the top sheet of a paper supply. When a sheet of paper is required, the roller is activated, which serves to feed a single sheet of paper into the printing mechanism.

In order to successfully feed single sheets of paper, a constant pressure between the feed roller(s) and the paper (to be fed) should be maintained, regardless of the amount of paper remaining in the paper supply. In the prior art, maintaining constant feed roller pressure was accomplished by use of springs and solenoids which moved the feed roller(s) and/or paper supply as the size of the paper supply decreased. In addition to being expensive, such prior art mechanisms were quite inaccurate and required periodic adjustment.

It is a general object of the present invention to overcome these and other drawbacks of the prior art by providing an improved sheet feeder tray for use in an automatic sheet feeder.

It is another object of the present invention to provide an improved sheet feeder tray for use in a single feed roller automatic sheet feeder.

It is yet another object of the present invention to provide a sheet feeder tray which does not utilize springs or solenoids to adjust its position as the paper supply is depleted and which can be produced at a low cost.

It is an additional object of the present invention to provide a sheet feeder tray which pivots about a single point to adjust for depletion in the paper supply.

It is a further object of the present invention to provide a pivotable sheet feeder tray which maintains the paper supply in constant pressure with a feed roller (as the paper supply is exhausted).

These and other objects, features and advantages of the present invention will become more apparent from the detailed description of the preferred embodiment when read in conjunction with the drawings.

SUMMARY OF THE INVENTION

In accordance with the present invention, a sheet feeder tray for use in a printer's automatic paper feeding mechanism is provided.

In the preferred embodiment, the sheet feeder tray includes an inner tray which is nested within an outer tray, the inner and outer trays hinged along their top ends. The inner tray is mounted to a frame via pivot pins located so that the paper supply in the inner tray contacts a fixed position roller which feeds single sheets of paper from the inner tray into a printer when the roller is rotated.

The outer tray includes retaining members at its bottom end. The paper supply is loaded in the inner tray with its lower corners behind the retaining members. As paper is dispensed from the inner tray, the inner tray pivots to put the next sheet of paper in contact with the fixed position roller. The outer tray, due to its hinged interconnection with the inner tray, rotates so as to maintain the retainers in position against the remaining paper supply.

In the preferred embodiment, the inner tray's pivot point is chosen to provide a constant pressure between the paper and the fixed feed roller, regardless of the amount of paper remaining in the inner tray.

DETAILED DESCRIPTION OF THE PREFERRED EMBODIMENT

Figure 1:
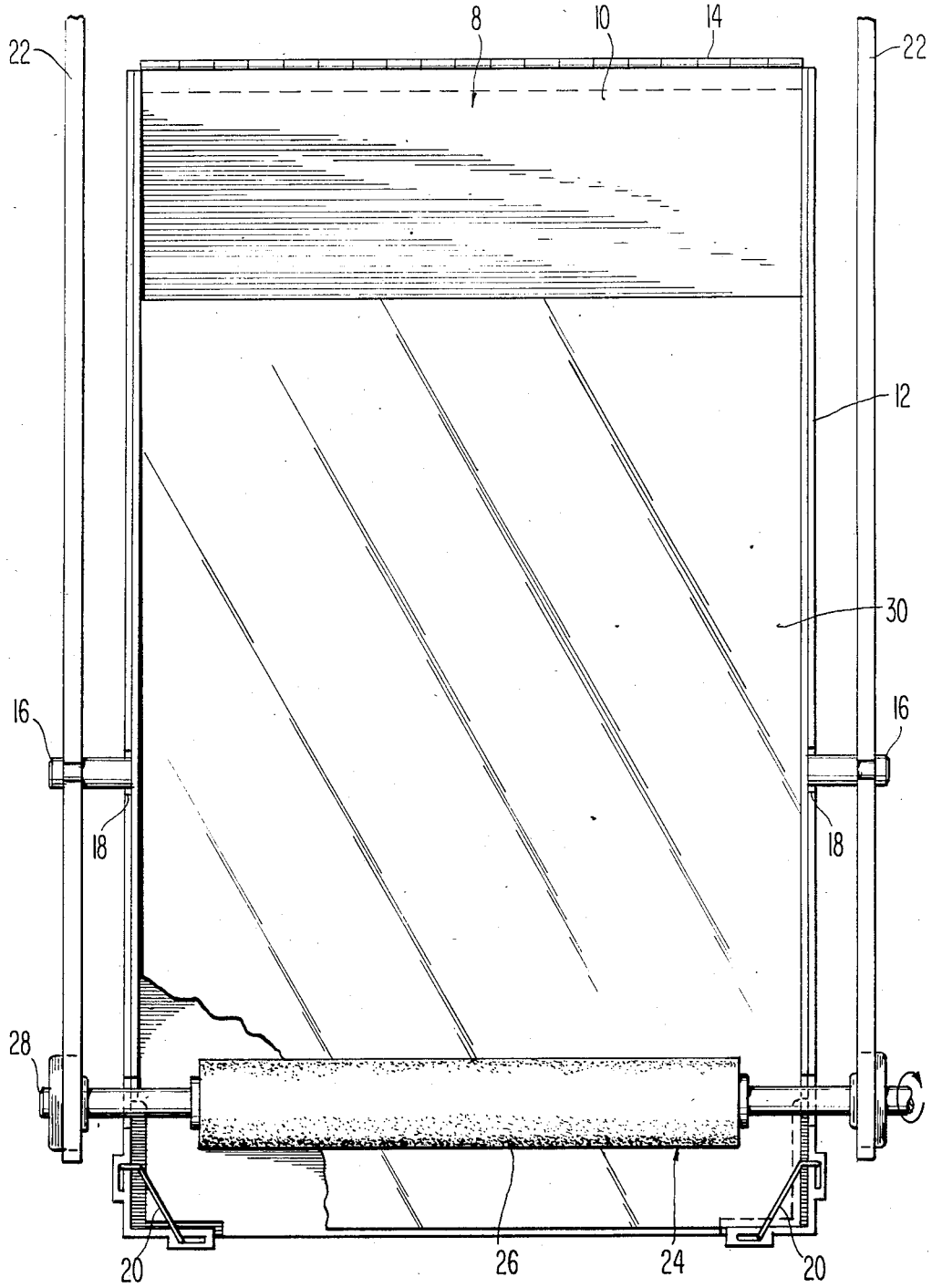
FIG. 1 is a front plan view of the sheet feeder tray.

Referring to the drawings, the feeder tray 8 includes an inner tray 10 and an outer tray 12 which are interconnected along their top ends by a hinge 14. Connected to the sides of inner tray 10 are pivot pins 16 which extend through corresponding slots 18 in the sides of the outer tray 12. Retaining members 20 span the lower corners of the outer tray 12. In the preferred embodiment, the retaining members 20 are fabricated of circular wire.

In the preferred embodiment, the feeder tray 8 is mounted between the sidewalls 22 of a frame (not shown) having slots or other openings to receive the notched portion of the pivot pins 16. Thus, the feeder tray 8 may be pivoted about the pivot pins 16.

Also mounted between the sidewalls 22 of the frame is roller assembly 24. The roller assembly 24 includes the picker roller 26 and the shaft 28. In the preferred embodiment, the shaft 28 passes through corresponding size holes in sidewalls 22. In the preferred embodiment, external means (not shown) are connected to shaft 28 so that roller assembly 24 may be rotated in the direction shown when it is desired to feed a sheet of paper 30.

With the elements of the feeder tray 8 now understood, the operation of the feeder tray 8 will be explained.

The feeder tray 8 may be loaded with paper 30 when it is installed in the frame, or the feeder tray 8 may be removed for loading. In the preferred embodiment, the operator may hold the bottoms of the inner and outer trays 10, 12 together, so the opposed surfaces of the inner and outer trays 10, 12 are in contact. In such a position, a supply of paper sheets 30 may be installed in the inner tray 10 with the lower corners of the paper supply 30 positioned behind retaining members 20.

In the preferred embodiment, the feeder tray 8 is used in conjunction with a letter quality printer such as those manufactured by Quame or Diablo. In such case, the frame supporting the feeder tray 8 is positioned above and in line with the printer's paper receiving mechanism. When a new sheet of paper 30 is required, the printer's control mechanism (not shown) activates roller assembly 24, the rotation of picker roller 26 in a counterclockwise direction causing a sheet of paper 30 to be dispensed from the bottom of the feeder tray 8.

In the preferred embodiment, the inner tray 10 is fabricated from metal in order to keep the inner tray 10 rigid. The outer tray 12 is fabricated from a lightweight plastic. However, those skilled in the art will appreciate that other materials may be utilized in place of those used in the preferred embodiment.

The choice of location of the pivot pins 16 on the sides of inner tray 10 will be discussed in more detail below. For the moment, it is enough to say that the pivot pins 16 are located low enough on the sides of the inner tray 10 so that the feeder tray 8 would rotate counterclockwise (FIG. 2) if such rotation was not blocked by roller 26. A counterclockwise rotational moment on the feeder tray 8 is present regardless of whether the inner tray 10 is full of paper 30 or empty.

Figure 2:
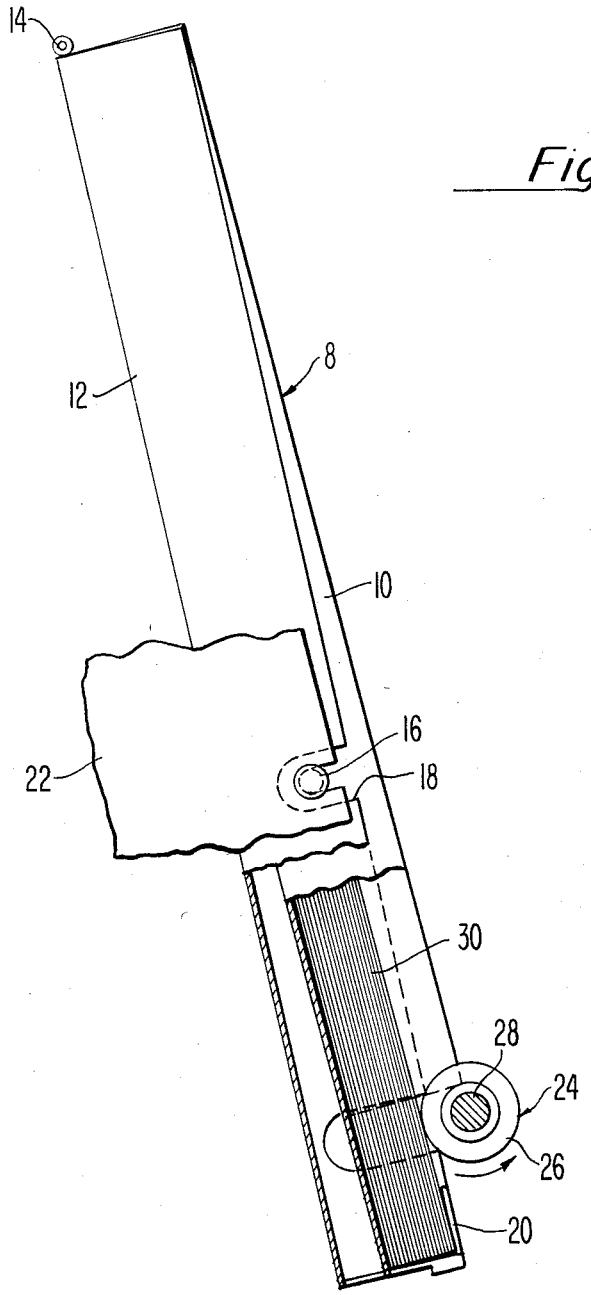
FIG. 2 is a side view of the sheet feeder tray of FIG. 1.

As each sheet of paper 30 is dispensed from the inner tray 10, the inner tray 10 rotates counterclockwise (FIG. 2) about pivot pins 16 to move the next sheet of paper supply 30 into contact with roller 24 at a predetermined pressure. As best can be seen in FIG. 2, the outer tray 12 movement is governed by the amount of paper 30 in the inner tray 10. As paper 30 is fed out of the inner tray 10, the outer tray 12 moves clockwise with respect to the inner tray 10 only.

FIG. 2 shows the inner tray 10 loaded to less than half of its paper 30 holding capacity. Notice that the inner tray 10 has rotated counterclockwise to position the top sheet of the paper supply 30 (adjacent to roller 26) into contact with the roller 26 surface. At the same time, outer tray 12 counter-rotates with respect to the inner tray 10. This (clockwise) counter-rotation causes the lower corners of the paper supply 30 to be held in position by retaining members 20 which contact the top sheet of the paper supply 30. As a result, when roller assembly 24 is activated, the corners of the top sheet of paper supply 30 are slid from behind the retaining members 20 as the sheet is fed from the inner tray 10. Of course, once the corners of the sheet of paper 30 being dispensed are free of the retaining members 20, they straighten out.

The retaining members 20 aid in assuring that only one sheet of paper 30 is dispensed at a time. In addition, they serve to keep the paper supply 30 remaining in the inner tray 10 positioned against the back of the inner tray 10.

Those skilled in the art will appreciate that it is desirable to maintain a constant feed roller 26 pressure to the paper 30 regardless of the quantity of paper 30 in the inner tray 10. This is necessary because too much pressure may result in multiple feeds and not enough pressure may result in a no feed condition (viz., the feed roller 26 just slides over the paper 30). Since the roller assembly 24 is in a fixed position, the only way of obtaining constant pressure is via the dispenser tray 8. The present invention accomplishes the maintanance of a completely constant feed roller 26 pressure by utilizing a properly chosen location for the pivot pins 16 on the inner tray 10. However, even if the pivot pins 16 are not located at the ideal position, the present invention will function, although not in an optimal manner (since the feed pressure will not remain constant). The discussion to follow will disclose how the ideal location of the pivot pins 16 is determined.

Figure 3A:
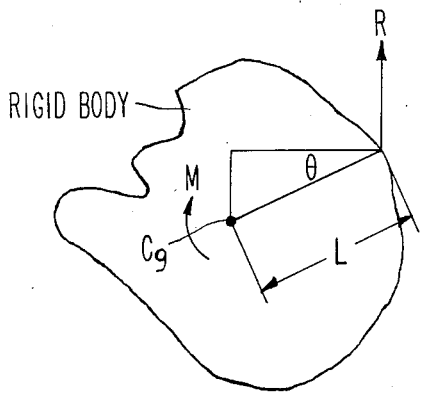
FIGS. 3A–3C illustrate the effects of a force acting through a distance about the center of gravity of a rotating body. Further, these figures illustrate the establishment of a single point for applying a constant moment as the body is rotated.
Figure 3B:
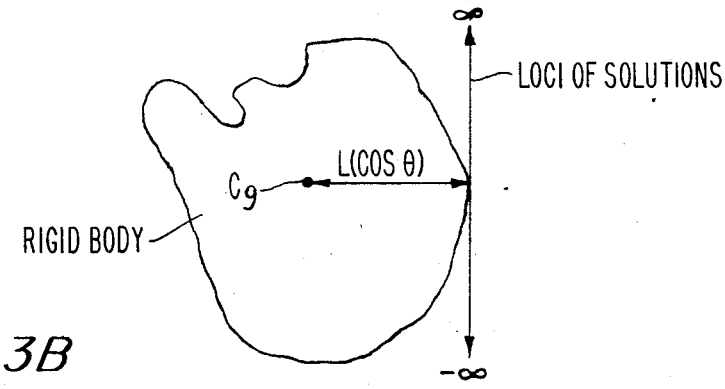

Referring now to FIG. 3A, from the laws of statics it is known that a force R acting through a distance L will cause a moment M about the center of gravity (cg) of a rigid body. It is also known that the length that the force acts upon is the magnitude of the distance that is perpendicular to the force R. Therefore, the magnitude of the moment M caused by R and L is $R \times L \cos \theta$. Referring to FIG. 3B, it can be seen that as long as force R is placed a distance of $L \cos \theta$ with respect to the horizontal plane, a moment M will always result so long as the product of $L (\cos \theta)$ remains the same (L and $\theta$ may vary). If all possible solutions are worked out, it can be seen that the loci of solutions forms a line, with a length of $L (\cos \theta)$. Therefore, as long as the rigid body in space does not move, any application of the force R applied somewhere along the line of "the loci of solutions" will cause a moment M.

Figure 3C:
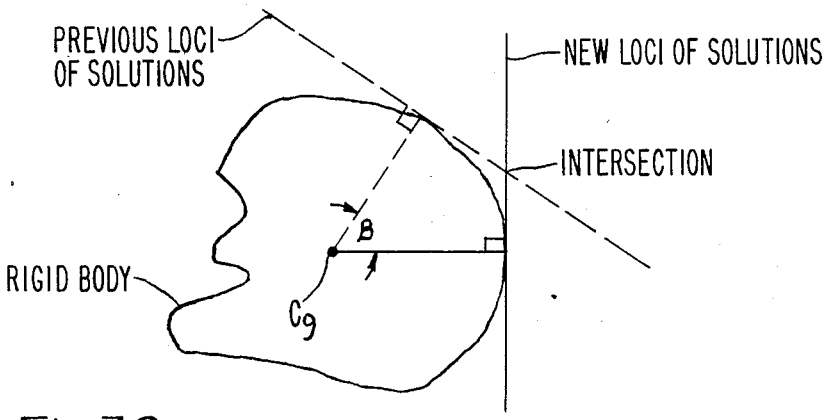

Referring now to FIG. 3C, if the rigid body is rotated through an angle $\beta$ and the moment M must remain the same as before the rotation, a new loci of solutions is formed. It can be seen from FIG. 3C that there exists a point in space which satisfies both the original and the final moment requirements, this point being called an intersection of solutions. If the moment required is linear, it can be shown that all loci of solutions pass through this intersection (see FIG. 4C), thereby keeping the moment M constant for all angles $\beta$.

This latter method of keeping the moment constant is directly applicable to the feeder tray 8. By the proper location of the pivot pins 16, the feeder tray 8 can be rotated through an angle $\beta$ while at the same time keeping the moment M about the inner tray's center of gravity constant, which in turn keeps the feed roller 26 pressure R constant.

In the preferred embodiment, the weight of inner tray 10 decreases linerly as each sheet of paper supply 30 is fed into the printer, thereby increasing the distance L required to keep the moment M constant. In addition, if the inner tray 10 is being pivoted around a pivot point (defined as an intersection of solutions), as each sheet of paper 30 is dispensed, the inner tray 10 increments to a new angle $\beta_{new}$. Therefore, if the different loci of solutions meet somewhere in space, then there is a physical point upon which to pivot the inner tray 10.

Figure 4A:
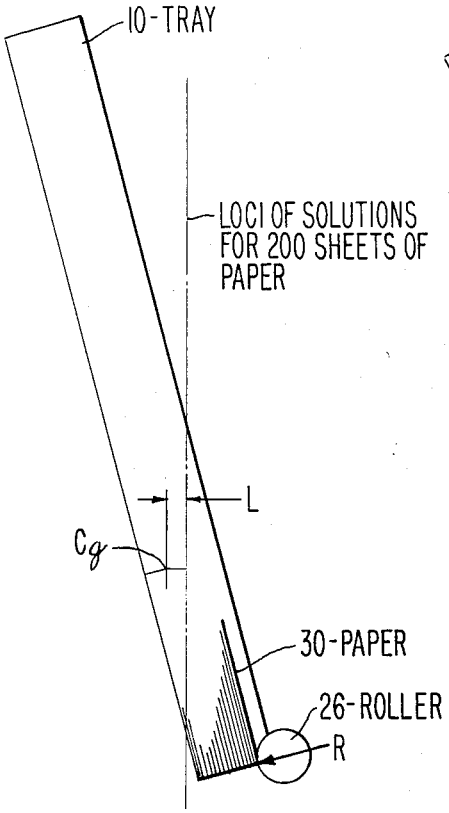
FIGS. 4A–4C illustrate the graphic solution for locating the pivot point in the preferred embodiment of the sheet feeder tray.
Figure 4B:
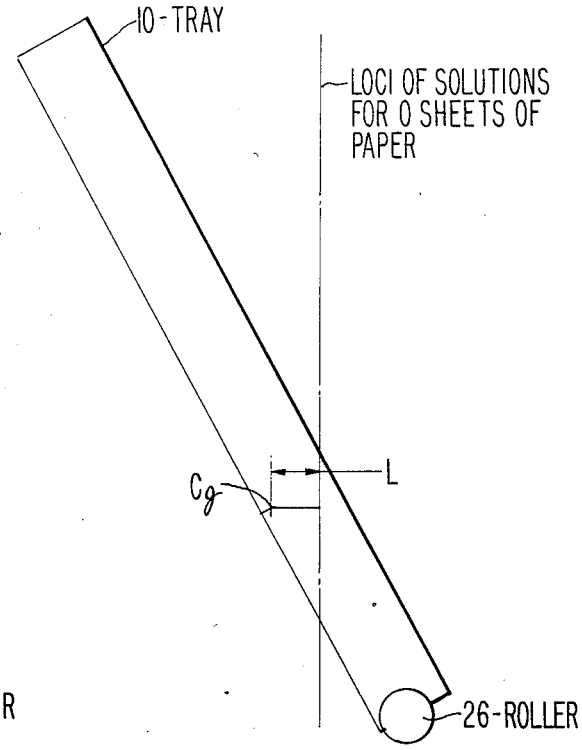

FIGS. 4A and 4B show an example illustrating the angular position of the inner tray 10 loaded with the maximum amount of paper 30 and empty, respectively. Also shown in each figure is the line of points (or loci of solutions) needed to keep the force R against the feed roller 26 for the corresponding state of the paper 30 supply, and the center of gravity cg of the inner tray 10 (taking into effect any paper 30 that may be in the inner tray 10). Those skilled in the art will appreciate that FIGS. 4A and 4B are exemplary only, the angular position of the inner tray 10, the location of the center of gravity cg, and the loci of solutions being dependent on the physical characteristics of the feeder tray 8, the paper 30, the roller 26, and other factors. Thus FIGS. 4A–4C do not consider the effect of the weight of the outer tray 12 on the feeder tray 8. However, those skilled in the art will be capable of deriving the data shown in FIGS. 4A and 4B for the particular embodiment of the feeder tray system they are utilizing.

As each sheet of paper 30 is fed out of inner tray 10, the combined weight of the inner tray 10 and remaining paper 30 is reduced and the angle of the inner tray 10 changes with respect to the horizontal plane. That is, as each sheet of paper 30 is fed, the bottom of inner tray 10 moves closer to roller 26. Referring again to FIGS. 4A and 4B, as the combined weight of inner tray 10 and paper supply 30 changes, the distance L will change accordingly in order to keep M constant. Since the center of gravity of the loaded inner tray 10 is a product of the center of gravity of the paper 30 and the center of gravity of the empty inner tray 10, as the paper supply 30 is depleted from the inner tray 10, this product causes the combined center of gravity of the inner tray 10 and paper 30 to move closer to the center of gravity of the inner tray 10 itself.

Figure 4C:
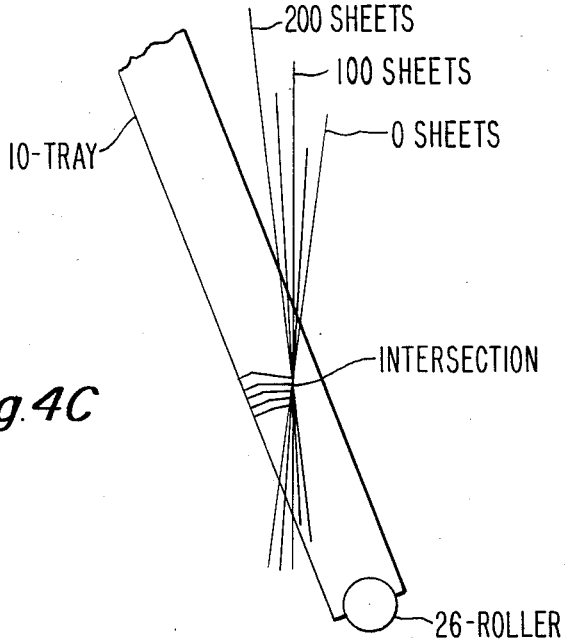

As previously discussed in reference to the body of FIG. 3C, if the different loci of solutions for the inner tray 10 in different stages of paper 30 fullness meet somewhere in space, a physical point exists at which to pivot the inner tray 10. FIG. 4C shows the combination of FIGS. 4A and 4B obtained by overlapping FIGS. 4A and 4B such that the inner trays 10 from each figure are coincident. In such case, an intersection of the loci-of-solutions occurs, the intersection defining the pivot point that the inner tray 10 should be rotated about.

Although not shown in separate figures, FIG. 4C also shows the loci of solutions obtained when the inner tray 10 is filled with a quantity of paper 30 which is less than its maximum capacity (of 200 sheets in the preferred embodiment) and greater than zero.

By determining the location of the optimum pivot point and locating the pivot pins 16 with their center at such a point, a constant feed roller 26 pressure on the paper 30 will be obtained regardless of the quantity of paper 30 in the inner tray 10.

Having thus, described the present invention in such full, clear, concise and exact terms as to enable any person skilled in the art to which it pertains to make and use the same, and having set forth the best mode contemplated of carrying out this invention, we state that the subject matter which we regard as being our invention is particularly pointed out and distinctly claimed in the following claims, it being understood that equivalents or modifications of, or substitutions for, parts of the specifically described embodiments of the invention may be made without departing from the scope of the invention as set forth in what is claimed.

What is claimed is:

1. A sheet feeder tray for maintaining a pressure between a feeder and a paper supply, said sheet feeder tray comprising:

inner tray means, pivotably supported in a semivertical position, for containing said paper supply, wherein said inner tray means includes a first flat rectangular back member, a first pair of sidewalls, one of said sidewalls extending from each side of said first rectangular back member, and a pair of pivot pins, one of said pivot pins rigidly connected to each one of said first pair of sidewalls; and outer tray means, said inner tray means being hinged on said outer tray means at the top end of said inner tray means and nested in said outer tray means, said outer tray means for preventing the simultaneous feeding of multiple sheets of said paper supply, wherein said outer tray means includes a second flat rectangular back member, a second pair of side members extending perpendicular to said second flat rectangular back member one from each side of said second rectangular back member and thence continuing partially across an end of said second back member, and a pair of retaining members, one of said retaining members extending across a corner formed by each one of said second pair of side members, wherein said first and second flat rectangular back members are hinged together at one of their respective ends and each one of said second pair of side members is cut out to accommodate one of said pivot pins as said inner tray means is rotated to a position where it is nested in said outer tray means.

2. The sheet feeder tray in accordance with claim 1 wherein said inner tray means includes means for pivoting said inner tray means to maintain said paper supply in contact with said feeder.

3. The sheet feeder tray in accordance with claim 2 wherein said pivoting means is located so that the pressure between said paper supply and said feeder is constant regardless of the size of said paper supply.

4. The sheet feeder tray in accordance with claim 2 wherein said inner tray means is nested within said outer tray means as said inner tray means is rotated about a hinge away from said outer tray means.

5. The sheet feeder tray in accordance with claim 1 wherein said inner tray means is hinged on said outer tray means at a first end of said outer tray means.

6. The sheet feeder tray in accordance with claim 1 wherein said inner tray means is pivotably supported between two members.

* * * * *